United States Patent [19]

Baer et al.

[11] 3,974,551

[45] Aug. 17, 1976

[54] THREAD CLAMP FOR WARP END TYING-IN MACHINES

[75] Inventors: Hans Baer; Kurt Reichert, both of Augsburg, Germany

[73] Assignee: Knotex Maschinenbau GmbH, Augsburg, Germany

[22] Filed: Oct. 28, 1975

[21] Appl. No.: 625,867

[30] Foreign Application Priority Data

Oct. 29, 1974 Germany ..... 2451258

[52] U.S. Cl. ..... 28/49; 289/13

[51] Int. Cl.[2] ..... D03J 1/18

[58] Field of Search ..... 28/49; 289/2, 3, 12, 289/13

[56] References Cited

UNITED STATES PATENTS

| | | | |
|---|---|---|---|
| 2,716,035 | 8/1955 | Thorndike | 289/13 |
| 3,138,396 | 6/1964 | Grönert | 289/12 |
| 3,378,899 | 4/1968 | Grönert | 28/49 |
| 3,615,112 | 10/1971 | Minke | 289/13 |
| 3,708,190 | 1/1973 | Beedy | 289/13 |

FOREIGN PATENTS OR APPLICATIONS

| | | | |
|---|---|---|---|
| 813,978 | 9/1951 | Germany | 28/49 |

*Primary Examiner*—Louis K. Rimrodt

*Attorney, Agent, or Firm*—Woodhams, Blanchard and Flynn

[57] ABSTRACT

Thread clamp for a warp end tying-in machine. In such a clamp, cam control means mechanically related to the remainder of the machine are provided for positively opening the clamps in order that the thread may be inserted therein without hindrance. The clamp is thereupon permitted to close and the mechanical means retracted therefrom in order that the clamp may be held in closed condition solely by the tension of adjustable resilient means applied thereto. With the mechanical means remaining inoperative with respect to the clamp, same is moved through a conventional operating cycle and back to its point of beginning. Mechanical means are thereupon again activated to open the clamp against the urging of said spring whereby the thread may be removed without restriction therefrom.

5 Claims, 4 Drawing Figures

THREAD CLAMP FOR WARP END TYING-IN MACHINES

FIELD OF THE INVENTION

The invention relates to a thread clamp for warp end tying-in machines, comprising two clamping jaws, which are pivotable about pivot axes arranged parallel to one another, an abutment bar which is arranged between the clamping jaws and each clamping jaw having a spring which presses the clamping jaw under an adjustable spring force against the abutment bar, together with a control shaft for controlling the remaining parts of the warp end tying-in machine.

BACKGROUND OF THE INVENTION

In a conventional thread clamp of this type (known from German Pat. No. 813,978), the clamping force by which each jaw is urged against the abutment bar can be adjusted by means of a screw or nut, which acts onto the spring. However, this clamping force remains constant during the entire tying operation. This results in a damage to the threads when the apparatus is handling delicate threads, for example Boucle or Effect threads. During the tying operation the clamped threads are pulled by the tying needle into the tying arbor and are caused to slide thereby between the clamping jaws and the abutment bar. Since Boucle and Effect threads have different thicknesses due to the loops and knots, this causes a variable clamping force to occur, which may be sufficient that the loops are pulled out or, in addition, a thread breakage can occur if a knot in the thread becomes caught in the thread clamp. Also when the threads are introduced into the closed thread clamp, difficulty and damage may occur due to the different thickness of the threads. It is not possible to overcome these deficiencies by reducing the spring force because the threads are then no longer held with a sufficient clamping force during a part of the tying operation.

Therefore the basic purpose of the invention is to produce a thread clamp for warp end tying-in machines of the above-mentioned type, which avoids damage to the threads which are to be tied and which is suited in particular for the holding of Boucle and Effect threads.

SUMMARY OF THE INVENTION

This purpose is attained according to the invention by providing for each clamping jaw one operating member which cooperates with said clamping jaw and is controlled by the control shaft, which operating member lifts the clamping jaw from the abutment bar at a selected point in the cycle of operation.

This automatically controlled new thread clamp has substantial advantages. The clamping force which is needed for the tying operation can be adjusted in the same manner as has been done previously, namely by regulating the spring tension. However, if the tying needle pulls the threads into the tying arbor and the threads are thereby moved a longer distance in their longitudinal direction, the clamping jaws are removed from the abutment bar. The threads can now be pulled through the clamp without substantial resistance, so that pulling open of loops, catching of threads due to a knot and the like are avoided. Should it be necessary, the thread clamp can be held open until during a tying operation the new threads have entered the thread clamp and lie between the clamping jaws and the abutment bar. In this manner, the clamping jaws and the remaining parts of the thread clamp in no way hinder the insertion of the threads. This makes damage to the threads impossible. The clamp is then subsequently closed by releasing the clamping jaws and the usual tying operation continues.

A further development of the invention is a particularly simple construction of the automatically controlled thread clamp, in which each clamp jaw is constructed as a two-arm lever, the one, front, lever arm of which cooperates with the abutment bar and the other, rear, lever arm of which cooperates with the operating member.

Further developments are characterized in the subclaims.

BRIEF DESCRIPTION OF THE DRAWINGS

One exemplary embodiment of the invention is illustrated in the drawings, in which.

DETAILED DESCRIPTION

Figure 1:
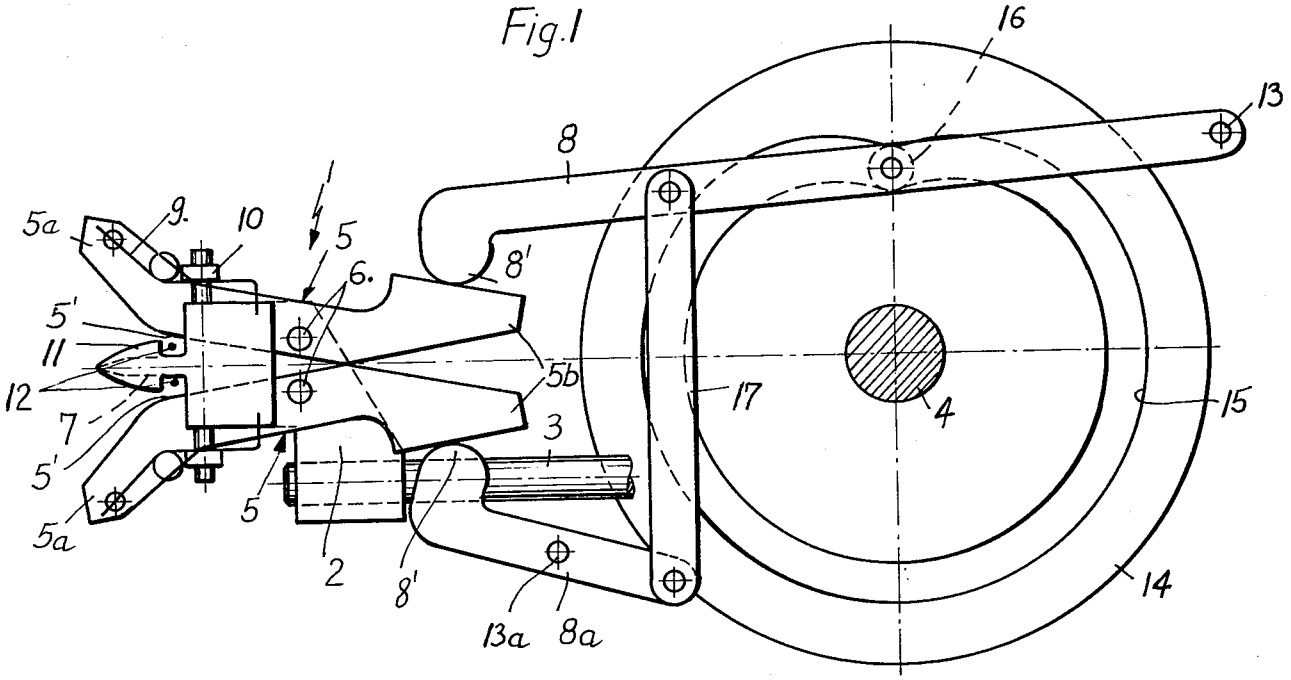
FIG. 1 is a side view of the thread clamp at the beginning or at the end of the tying operation.

The entire thread clamp is identified by reference numeral 1 in the drawings. The thread clamp has a holder 2, which is secured on a rod 3 which can be moved back and forth in the direction A and the reciprocal thereof. The movement of this rod, as well as the movement of the remaining parts of the tying-in machine, is controlled by the control shaft 4.

Two clamping jaws 5 are supported pivotally about axes 6, which are arranged parallel to one another on the holder 2. Since the clamping jaws are constructed alike, the same reference numerals are used and the discussions relating to one clamping jaw will apply also to the other. The pivot axes 6 extend perpendicularly with respect to the direction of movement A of the rod 3 and parallel with respect to the clamping surfaces 5' of the clamping jaws 5. An abutment bar 7 is arranged between the clamping jaws 5.

Each clamping jaw is advantageously constructed as a two-arm lever. The front lever arms **5*a* cooperate with the abutment bar 7 and the rear lever arms 5*b* cooperate with operating members 8 and 8*a*. Further, springs 9 act onto the front lever arms 5*a*, the spring tension of said springs can each be regulated by the nuts 10. The holding bar 11 which is arranged laterally of the front clamping jaw lever arms 5*a* is already known and has on both sides of the abutment bar two recesses, which are used for positioning the threads 12 which are to be clamped. The holding bar 11** is intended to prevent the threads from reaching either too far into the clamp, through which the clamping power which acts onto the threads would increase, or from accidentally escaping forwardly out of the clamp.

The operating members **8, 8*a* are constructed advantageously as rocking levers and are supported pivotally about the stationary axes 13 or 13*a*. To control the rocking lever 8, a cam plate 14 which is arranged on the control shaft 4 is used, the groove 15 of said cam plate being engaged by a roller 16 which is arranged on the lever 8. The rocking lever 8*a* is connected to the rocking lever 8 through a guide rod 17**.

Figure 2:
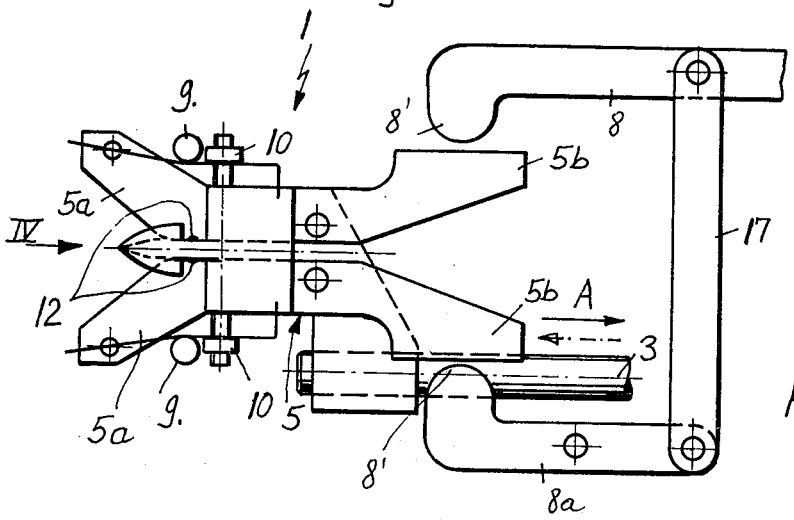
FIGS. 2 and 3 are side views of two different intermediate positions of the thread clamp during the tying operation.
Figure 4:
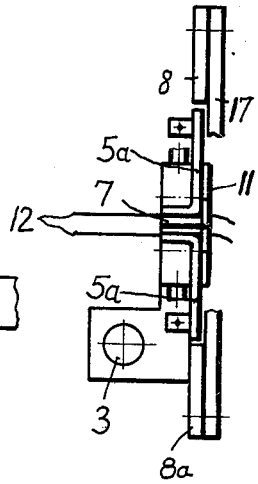
FIG. 4 is a front view of the thread clamp in the direction IV of FIG. 2.
Figure 3:
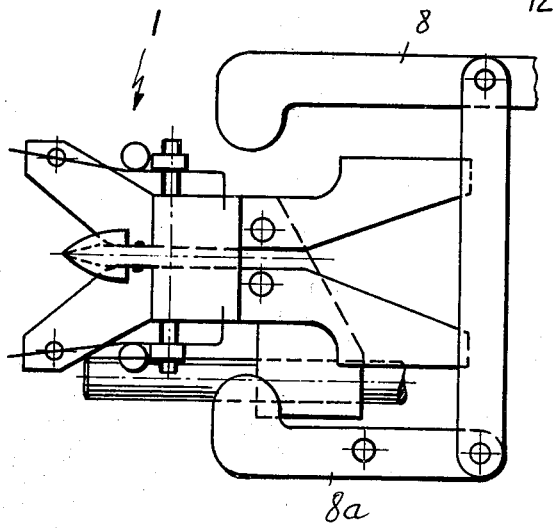

If the thread clamp 1 is in its starting position, as illustrated in FIG. 1, in which the cam follower 16 is at the low point of cam groove 15, the free ends 8' of the rocking levers 8 and 8*a* approach one another. Said free ends 8' act onto the rear lever arms 5*b* of the clamping jaws 5 and thereby lift the front lever arms 5*a* from the abutment bar 7. The clamp is thus opened and the threads 13 can enter unhindered into the opened clamp. Upon further rotation of the control shaft 4, the free ends 8' of the rocking levers 8, 8*a* are moved apart, so that they, as shown in FIG. 2, are spaced from the rear lever arm 5'. The springs 9 thereupon cause the clamp to close. The force with which the clamping jaws press with their clamping surfaces 5' onto the abutment bar 7, is thereby determined solely by the tension of the springs 9. During the further tying operation, the closed thread clamp is moved rearwardly in direction A (FIG. 3) by the rod 3, which is necessary so that the threads can be gripped in a conventional manner by the tying arbor and can be placed around same. The thread clamp moves then again forwardly in the opposite direction. At this point the tying needle pulls the threads into the tying arbor, which causes these to be pulled through transversely to the clamping jaws and thus perpendicularly with respect to the drawing plane according to FIGS. 1 to 3. At this point, the cam plate 14 has rotated sufficiently that the free ends 8' of the rocking levers 8, 8*a* are moved again toward one another and thus open the clamp according to FIG. 1. The threads can subsequently be pulled unrestrictedly through the open clamp.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is clamed are defined as follows:

1. In a thread clamp for warp end tying-in machines, comprising two clamping jaws, which are pivotal about pivot axes which are arranged parallel to one another, an abutment bar which is arranged between the clamping jaws and a spring for each clamping jaw, said spring pressing the clamping jaw against the abutment bar with an adjustable spring force and a control shaft for controlling the remaining parts of the warp end tying-in machine, the improvement comprising wherein for each clamping jaw there is provided an operating member which cooperates with said clamping jaw and which is controlled by the control shaft, said operating member lifting the clamping jaw off from the abutment bar at a selected point in the operating cycle.

2. The improved thread clamp according to claim 1, wherein each clamping jaw is constructed as a two-arm lever, the one, front, lever arm of which cooperates with the abutment bar and the other, rear, lever arm of which cooperates with the operating member.

3. The improved thread clamp according to claim 2, wherein the thread clamp is arranged in a conventional manner movably back and forth perpendicularly with respect to the control shaft and wherein the operating members are constructed as rocking levers which are movable about stationary axes, the free ends of which are arranged in the range of movement of the rear lever arms of the clamping jaw.

4. The improved thread clamp according to claim 3, wherein the rocking levers are driven by a cam plate which is arranged on the control shaft.

5. The improved thread clamp according to claim 3, wherein the free ends of the rocking levers are arranged spaced from the rear lever arms during the back-and-forth movement of the thread clamp and are in contact with the rear lever arms only for opening the clamp.

* * * * *